US005485543A

United States Patent [19]

Aso

[11] Patent Number: 5,485,543

[45] Date of Patent: Jan. 16, 1996

[54] METHOD AND APPARATUS FOR SPEECH ANALYSIS AND SYNTHESIS BY SAMPLING A POWER SPECTRUM OF INPUT SPEECH

[75] Inventor: Takashi Aso, Yokohama, Japan

[73] Assignee: Canon Kabushiki Kaisha, Tokyo, Japan

[21] Appl. No.: 257,429

[22] Filed: Jun. 8, 1994

Related U.S. Application Data

[63] Continuation of Ser. No. 987,053, Dec. 7, 1992, abandoned, which is a continuation of Ser. No. 490,462, Mar. 8, 1990, abandoned.

[30] Foreign Application Priority Data

Mar. 13, 1989 [JP] Japan ..... 1-60371

[51] Int. Cl.[6] ..... G10L 9/00

[52] U.S. Cl. ..... 395/2.76; 395/2.67; 395/2.23

[58] Field of Search ..... 381/29–40; 395/2.14–2.23, 395/2.34, 2.67–2.78

[56] References Cited

U.S. PATENT DOCUMENTS 4,885,790 12/1989 McAulay ..... 381/36

OTHER PUBLICATIONS

"Speech Analysis–Synthesis System and Quality of Synthesized Speech Using Mel–Cepstrum", T. Kitamura, Electronic and Communications of Japan, Part 1, vol. 69, No. 10, Oct. 1986, pp. 47–54.

"Cepstral Analysis Synthesis On The Mel Frequency Scale", S. Imai, ICASSP '83—IEEE International Conference on Acoustics, Speech and Signal Processing, Boston, Apr. 14–16, 1983, vol. 1, pp. 93–96.

"Estimation of Poles and Zeros of Voiced Speech Using Group Delay Characteristics Derived From Spectral Envelopes", N. Mikami, et al., Electronics and Communications in Japan, Part 1, vol. 69, No. 3, Mar. 1986, pp. 38–44.

"The Spectral Envelope Estimation Vocoder", D. Paul, IEEE Transactions on Acoustics, Speech, and Signal Processing, vol. ASSP–29, No. 4, Aug. 1981, pp. 786–794.

*Primary Examiner*—Allen R. MacDonald
*Assistant Examiner*—Michelle Doerrler
*Attorney, Agent, or Firm*—Fitzpatrick, Cella, Harper & Scinto

[57] ABSTRACT

A method for speech analysis and synthesis for obtaining synthesized speech of a high quality includes the steps of determining a short-period power spectrum by performing an FFT operation on a speech wave, sampling the spectrum at the positions corresponding to the multiples of a basic frequency, applying a cosine polynomial model to the thus obtained sample points to determine the spectrum envelope thereat, then calculating the mel cepstrum coefficients from the spectrum envelope, and effecting speech synthesis, utilizing the mel cepstrum coefficients as the filter coefficients in a synthesizing (logarithmic mel spectrum approximation) filter.

10 Claims, 3 Drawing Sheets

METHOD AND APPARATUS FOR SPEECH ANALYSIS AND SYNTHESIS BY SAMPLING A POWER SPECTRUM OF INPUT SPEECH

This application is a continuation of application Ser. No. 07/987,053 filed Dec. 7, 1992, which is a continuation of application Ser. No. 07/490,462 filed Mar. 8, 1990, both now abandoned.

BACKGROUND OF THE INVENTION

1. Field of the Invention

The present invention relates to a speech analyzing and synthesizing method, for analyzing speech into parameters and synthesizing speech again from the parameters.

2. Related Background Art

As a method for speech analysis and synthesis, there is already known the mel cepstrum method.

In this method, speech analysis for obtaining spectrum envelope information is conducted by determining a spectrum envelope by the improved cepstrum method, and converting it into cepstrum coefficients on a non-linear frequency scale similar to the mel scale. Speech synthesis is conducted using a mel logarithmic spectrum approximation (MLSA) filter as the synthesizing filter, the speech is synthesized by entering the cepstrum coefficients, obtained by the speech analysis, as the filter coefficients.

The Power spectrum envelope method is also known in this field (PSE).

In the speech analysis using this method, the spectrum envelope is determined by sampling a power spectrum, obtained from the speech wave by FFT, at positions of multiples of a basic frequency, and smoothy connecting the obtained sample points with consine polynomials. Speech synthesis in conducted by determining zero-phase impulse response waves from thus obtained spectrum envelope and superposing the waves at the basic period (reciprocal of the basic frequency).

Such conventional methods, however, have been associated with following drawbacks.

(1) In the mel cepstrum method, at the determination of the spectrum envelope by the improved cepstrum method, the spectrum envelope tends to vibrate depending on the relation between the order of the cepstrum coefficient and the basic frequency of the speech. Consequently, the order of the cepstrum coefficient has to be regulated according to the basic frequency of the speech. Also this method is unable to follow a rapid change in the spectrum, if it has a wide dynamic range between the peak and the zero level. For these reasons, speech analysis in the mel cepstrum method is unsuitable for precise determination of the spectrum envelope, and gives rise to a deterioration in the tone quality. On the other hand, speech analysis in the PSE method is not associated with such drawback, since the spectrum is sampled with the basic frequency and the envelope is determined by an approximating curve (cosine polynomials) passing through the sample points.

(2) However, in the PSE method, speech synthesis by the superposition of zero-phase impulse response waves requires a buffer memory for storing the synthesized wave, in order to superpose the impulse response waves symmetrically to a time zero. Also, since the superposition of impulse response waves takes place in the synthesis of a voiceless speech period, a cycle period of superposition inevitably exists in the synthesized sound of such voiceless speech period. Thus the resulting spectrum is not a continuous spectrum, such as that of white noise, but becomes a line spectrum having energy only at multiples of the superposing frequency. Such a property is quite different from that of actual speech. For these reasons speech synthesis using the PSE method is unsuitable for real-time processing, and the characteristics of the synthesized speech are not satisfactory. On the other hand, the speech synthesis in the mel cepstrum method is easily capable of real-time processing for example with a DSP because of the use of a filter (MLSA filter), and can also prevent the drawback in the PSE method, by changing the sound source between a voiced speech period and an unvoiced speech period, employing white noise as the source for the unvoiced speech period.

SUMMARY OF THE INVENTION

In consideration of the foregoing, the object of the present invention is to provide an improved method of speech analysis and synthesis, which is not associated with the drawbacks of the conventional methods.

According to the present invention, the spectrum envelope is determined by obtaining a short-period power spectrum by FFT on speech wave data of a short period, sampling the short-period power spectrum at the positions corresponding to multiples of a basic frequency, and applying a cosine polynomial model to the thus obtained sample points. The synthesized speech is obtained by calculating the mel cepstrum coefficients from the spectrum envelope, and using the mel cepstrum coefficients as the filter coefficients for the synthesizing (MLSA) filter. Such a method allows one to obtain high-quality synthesized speech in a more practical manner.

DESCRIPTION OF THE PREFERRED EMBODIMENTS

[An embodiment utilizing frequency axis conversion in the determination of mel cepstrum coefficients]

Figure 1:
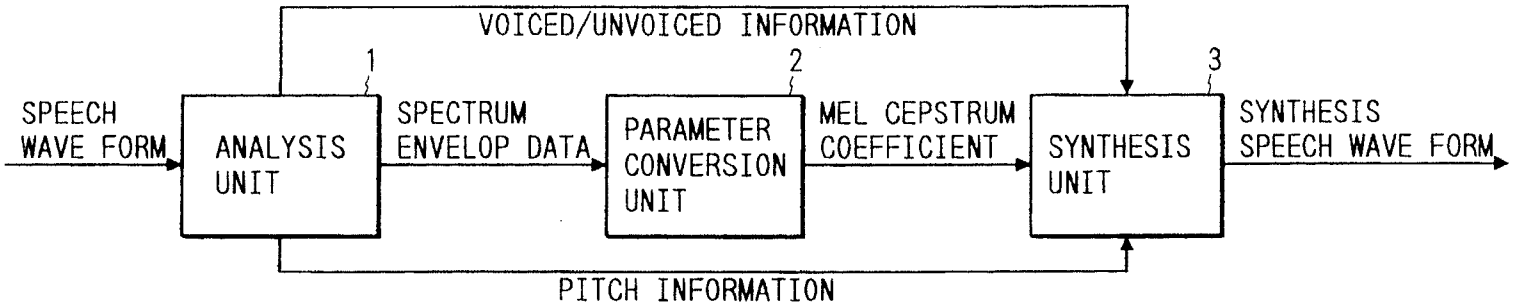
FIG. 1 is a block diagram of an embodiment of the present invention.

FIG. 1 is a block diagram best representing the features of the present invention, wherein shown are an analysis unit 1 for generating logarithmic spectrum envelope data by analyzing a short-period speech wave (a unit time being called a frame), determining whether the speech is voiced or unvoiced, and extracting the pitch (basic frequency); a parameter conversion unit 2 for converting the envelope data, generated in the analysis unit 1, into mel cepstrum coefficients; and a synthesis unit 3 for generating a synthesized speech wave from the mel cepstrum coefficients obtained in the parameter conversion unit 2 and the voiced/unvoiced information and the pitch information obtained in the analysis unit 1.

Figure 2:
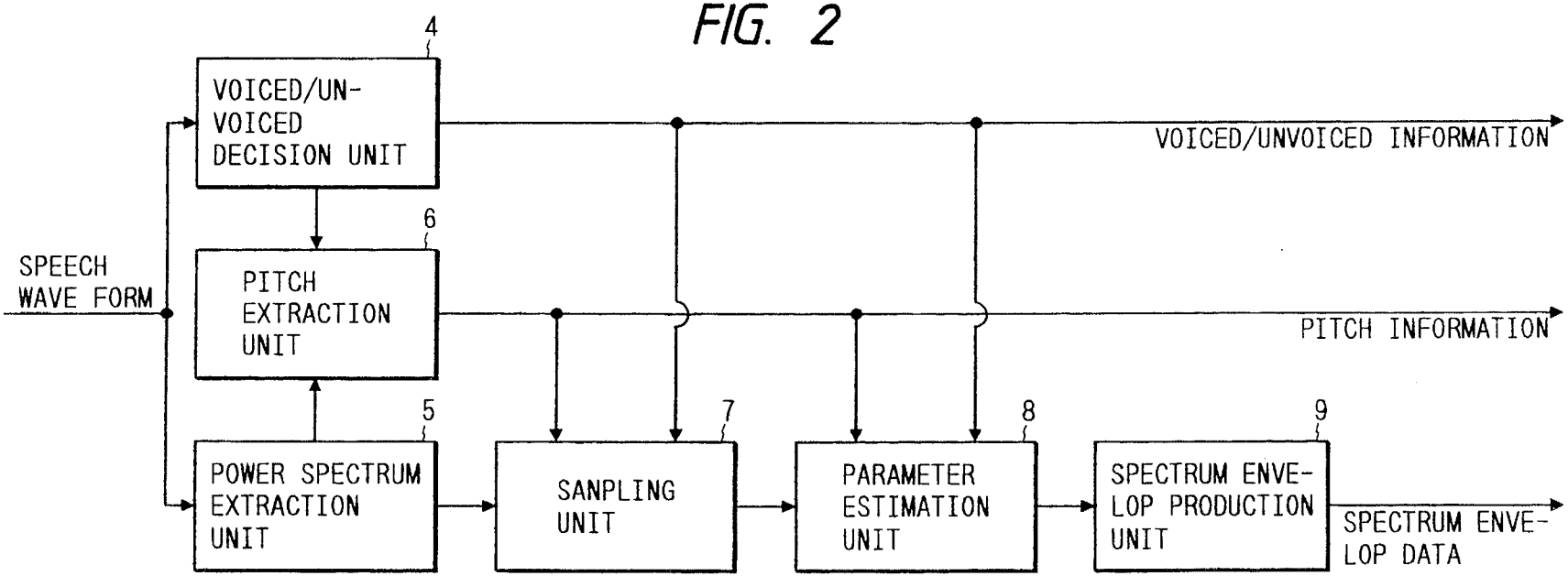
FIG. 2 is a block diagram of an analysis unit shown in FIG. 1.

FIG. 2 shows the structure of the analysis unit 1 shown in FIG. 1 and includes: a voiced/unvoiced decision unit 4 for determining whether the input speech of a frame is voiced or unvoiced; a pitch extraction unit 5 for extracting the pitch (basic frequency) of the input frame; a power spectrum extraction unit 6 for determining the power spectrum of the input speech of a frame; a sampling unit 7 for sampling the power spectrum, obtained in the power spectrum extraction unit 6, with a pitch obtained in the pitch extraction unit; a parameter estimation unit 8 for determining coefficients by applying a cosine polynomial model to a train of sample points obtained in the sampling unit 7; and a spectrum envelope generation unit 9 for determining the logarithmic spectrum envelope from the coefficients obtained in the parameter estimation unit 8.

Figure 3:
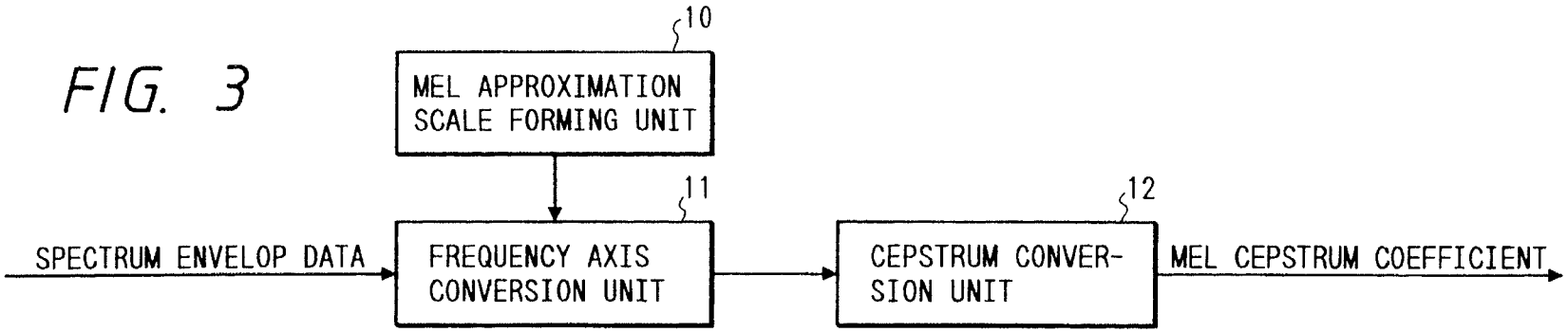
FIG. 3 is a block diagram of a parameter conversion unit shown in FIG. 1.

FIG. 3 shows the structure of the parameter conversion unit shown in FIG. 1. There are provided a mel approximation scale forming unit 10 for forming an approximate frequency scale for converting the frequency axis into the mel scale; a frequency axis conversion unit 11 for converting the frequency axis into the mel approximation scale; and a mel cepstrum conversion unit 12 for generating cepstrum coefficients from the logarithmic spectrum envelope.

Figure 4:
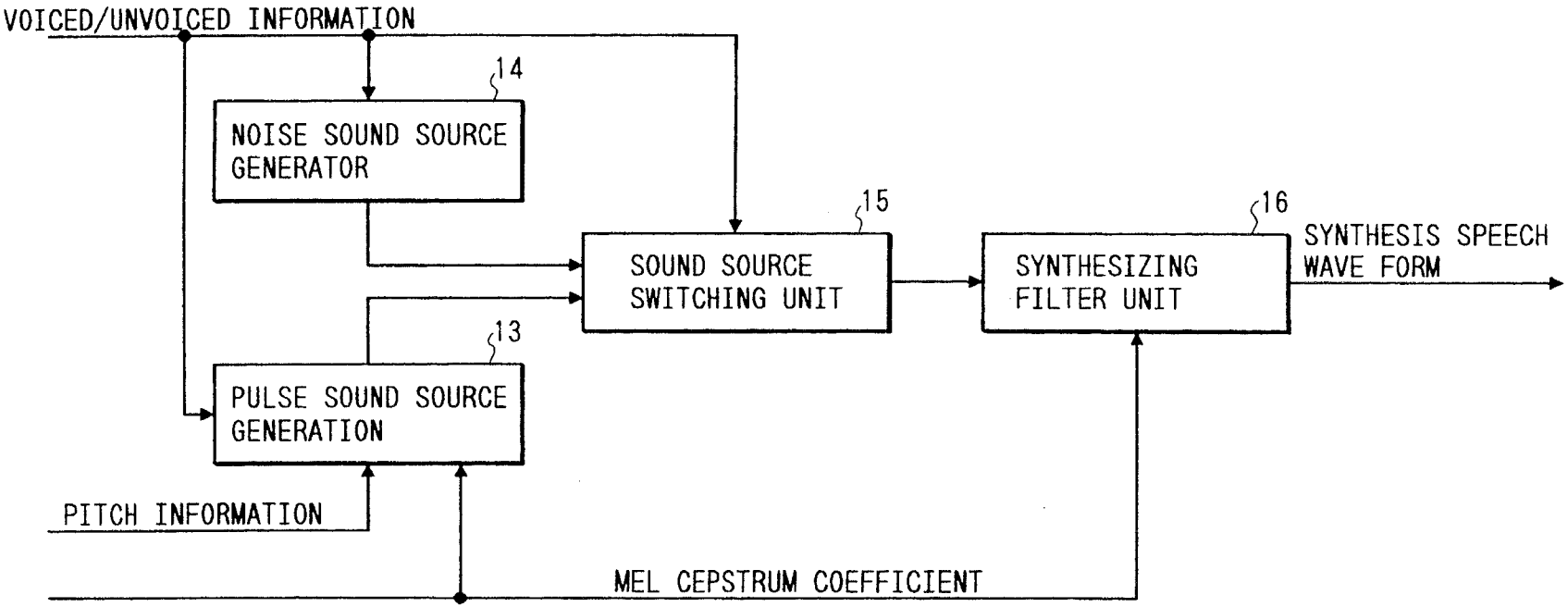
FIG. 4 is a block diagram of a synthesis unit shown in FIG. 1.

FIG. 4 shows the structure of the synthesis unit shown in FIG. 1. There are provided a pulse sound source generator 13 for forming a sound source for a voiced speech period; a noise sound source generator 14 for forming a sound source for an unvoiced speech period; a sound source switching unit 15 for selecting the sound source according to the voiced/unvoiced information from the voiced/unvoiced decision unit 4; and a synthesizing filter unit 16 for forming a synthesized speech wave from the mel cepstrum coefficients and the sound source.

The function of the present embodiment will be explained in the following.

In the following explanation there are assumed the following speech data:

sampling frequency: 12 kHz frame length: 21.33 msec (256 data points)

frame cycle period: 10 msec (120 data points)

At first, when speech data of a frame length are supplied to the analysis unit 1, the voiced/unvoiced decision unit 4 determines whether the input frame is a voiced speech period or an unvoiced speech period.

The power spectrum extraction unit 5 executes a window process (a Blackman window or a Hunning window, for example) on the input data of a frame length, and determines the logarithmic power spectrum by an FTT process. The number of points in the FTT process should be selected to be a relatively large value (for example 2048 points) since the resolving power of the frequency should be selected fine for determining the pitch in the ensuing process.

If the input frame is a voiced speech period, the pitch extraction unit 6 extracts the pitch. This can be done, for example, by determining the cepstrum by an inverse FFT process of the logarithmic power spectrum obtained in the power spectrum extraction unit 5 and defining the pitch (basic frequency: fo(Hz)) by the reciprocal of a cefrency (sec) giving a maximum value of the cepstrum. As the pitch does not exist in an unvoiced speech period, the pitch is defined as a sufficiently low constant value (for example 100 Hz).

Then the sampling unit 7 executes sampling of the logarithmic power spectrum, obtained in the power spectrum extraction unit 5, with the pitch interval (positions corresponding to multiples of the pitch) determined in the pitch extraction unit 6, thereby obtaining a train of sample points.

The frequency band for determining the train of sample points is advantageously in a range of 0–5 kHz in case of a sampling frequency of 12 kHz, but is not necessarily limited to such a range. However it should not exceed ½ of the sampling frequency, based on the rule of sampling. If a frequency band of 5 kHz is needed, the upper frequency F (Hz) of the model and the number N of sample points can be defined by the minimum value of fo×(N−1) exceeding 5000.

Then the parameter estimation unit 8 determines, from the sample point train $y_i$ (i=0, 1, . . . N−1) obtained in the sampling unit, coefficients Ai (i=0, 1, . . . , N−1) of cosine polynomial of N terms:

$$Y(\lambda) = \sum_{i=0}^{N-1} Ai \cos i\lambda, \ (0 \leqq \lambda \leqq \pi) \tag{1}$$

However the value $y_0$, which is the value of logarithmic power spectrum at zero frequency, is approximated by $y_1$, because the value at zero frequency in FFT is not exact. The value Ai can be obtained by minimizing the sum of square of the error between the sample points $y_i$ and Y(λ):

$$J = \sum_{i=0}^{N-1} [Y(\delta) - y_i]^2, \ \delta = \pi/(N-1) \tag{2}$$

More specifically the values are obtained by solving N simultaneous first-order equations obtained by partially differentiating J with $A_0, A_1, \ldots, A_{N-1}$ and placing the results equal to zero.

Then the spectrum envelope generation unit 9 determines the logarithmic spectrum envelope data from $A_0, A_1, \ldots, A_{N-1}$ obtained in the parameter estimation unit, according to an equation:

$$Y(\lambda)=A_0+A_1 \cos \lambda+A_2 \cos 2\lambda+ \ldots + A_{N-1} \cos (N-1)\lambda \tag{3}$$

The foregoing explains the generation of the voiced/unvoiced information, pitch information and logarithmic spectrum envelope data in the analysis unit 1.

Then the parameter conversion unit 2 converts the spectrum envelope data into mel cepstrum coefficients.

At first the mel approximation scale forming unit 10 forms a non-linear frequency scale approximating the mel frequency scale. The mel scale is a psychophysical quantity representing the frequency resolving power of hearing ability, and is approximated by the phase characteristic of a first-order all-passing filter. For the transmission characteristic of the filter:

$$H(z) = \frac{z^{-1} - \alpha}{1 - \alpha z^{-1}} \tag{4}$$

the frequency characteristics are given by:

$$H(e^{j\Omega}) = \exp(-j\beta(\Omega)) \tag{5}$$

$$\beta(\Omega) = \Omega + 2\tan^{-1}\left(\frac{\alpha \sin\Omega}{1 - \alpha\cos\Omega}\right) \tag{6}$$

wherein Ω=ωΔt, Δt is the unit delay time of the digital filter, and ω is the angular frequency. It is already known that a non-linear frequency scale Ω=β(Ω) coincides well with the mel scale by selecting the value α in the transmission function H(z) arbitrarily in a range from 0.35 (for a sampling frequency of 10 kHz) to 0.46 (for a sampling frequency of 12 kHz).

Then the frequency axis conversion unit 11 converts the frequency axis of the logarithmic spectrum envelope determined in the analysis unit 1 into the mel scale formed in the mel approximation scale forming unit 10, thereby obtaining mel logarithmic spectrum envelope. The ordinary logarithmic spectrum $G_1(\Omega)$ on the linear frequency scale is converted into the mel logarithmic spectrum $G_m(\Omega)$ according to the following equations:

$$G_m(\Omega) = G_l(\beta^{-1}(\Omega)) \tag{8}$$

$$\beta^{-1}(\tilde{\Omega}) = \tilde{\Omega} + 2\tan^{-1}\left(\frac{\alpha\sin\tilde{\Omega}}{1-\alpha\cos\tilde{\Omega}}\right) \tag{9}$$

The cepstrum conversion unit 12 determines the mel cepstrum coefficients by an inverse FFT operation on the mel logarithmic spectrum envelope data obtained in the frequency axis conversion unit 11. The number of orders can be theoretically increased to ½ of the number of points in the FFT process, but is in a range of 15–20 in practice.

The synthesis unit 3 generates the synthesized speech wave, from the voiced/unvoiced information, pitch information and mel cepstrum coefficients.

At first, sound source data are prepared in the noise sound source generator 13 or the pulse sound source generator 14 according to the voiced/unvoiced information. If the input frame is a voiced speech period, the pulse sound source generator 14 generates pulse waves of an interval of the aforementioned pitch as the sound source. The amplitude of the pulse is controlled by the first-order term of the mel cepstrum coefficients, representing the power (loudness) of the speech. If the input frame is an unvoiced speech period, the noise sound source generator 13 generates M-series white noise as the sound source.

The sound source switching unit 15 supplies, according to the voiced/unvoiced information, the synthesizing filter unit either with the pulse train generated by the pulse sound source generator 14 during a voiced speech period, or the M-series white noise generated by the noise sound source generator 13 during an unvoiced speech period.

The synthesizing filter unit 16 synthesizes the speech wave, from the sound source supplied from the sound source switching unit 15 and the mel cepstrum coefficients supplied from the parameter conversion unit 2, utilizing the mel logarithmic spectrum approximation (MLSA) filter.

[Embodiment utilizing equation in determining mel cepstrum coefficients]

The present invention is not limited to the foregoing embodiment but is subject to various modifications. As an example, the parameter conversion unit 2 may be constructed as shown in FIG. 5, instead of the structure shown in FIG. 3.

Figure 5:
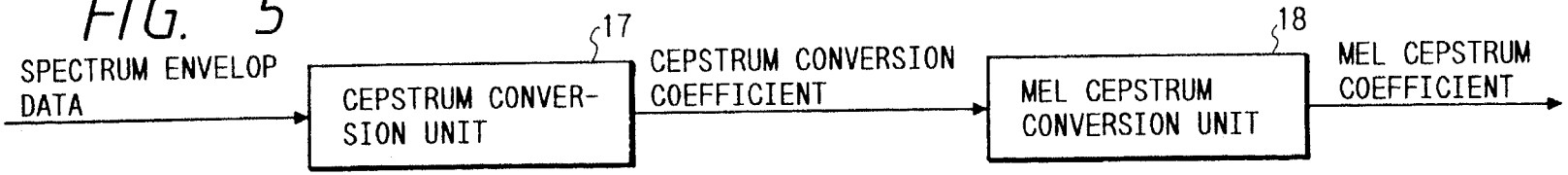
FIG. 5 is a block diagram of another embodiment of the parameter conversion unit shown in FIG. 1.

In FIG. 5, there are provided a cepstrum conversion unit 17 for determining the cepstrum coefficients from the spectrum envelope data; and a mel cepstrum conversion unit for converting the cepstrum coefficients into the mel cepstrum coefficients. The function of the above-mentioned structure is as follows.

The cepstrum conversion unit 17 determines the cepstrum coefficients by applying an inverse FFT process on the logarithmic spectrum envelope data prepared in the analysis unit 1.

Then the mel cepstrum conversion unit 18 converts the cepstrum coefficients C(m) into the mel cepstrum coefficients $C_\alpha(m)$ according to the following regression equations:

$$\mu_k^{(n)} = \begin{cases} C(-n) + \alpha\mu_0^{(n-1)}, & k=0 \\ (1-\alpha^2)\mu_0^{(n-1)} + \alpha\mu_1^{(n-1)}, & k=1 \\ \mu_{k-1}^{(n-1)} + \alpha(\mu_k^{(n-1)} - \mu_{k-1}^{(n)}), & k>1 \end{cases} \tag{10}$$

$$n = \ldots, -2, -1, 0$$

-continued $$C_\alpha(m) = \mu_m^{(0)},\ m = 0, 1, 2, \ldots \tag{11}$$

[Apparatus for ruled speech synthesis]

Figure 6:
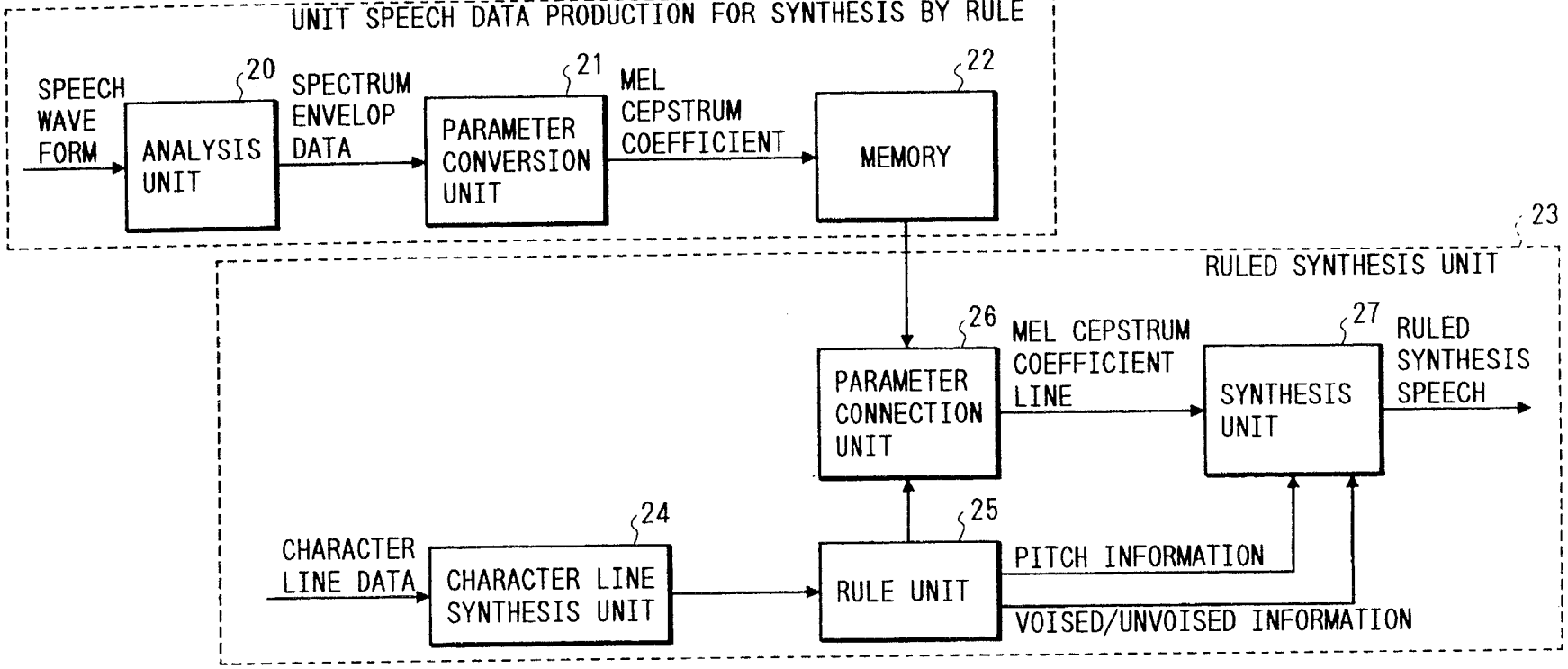
FIG. 6 is a block diagram of another embodiment of the present invention.

Although the foregoing description has been limited to an apparatus for speech analysis and synthesis, the method of the present invention is not limited to such an embodiment and is applicable also to an apparatus for ruled speech synthesis, as shown by an embodiment in FIG. 6.

In FIG. 6 there are shown a unit 19 for generating unit speech data (for example monosyllable data) for ruled speech synthesis; an analysis unit 20, similar to the analysis unit 1 in FIG. 1, for obtaining the logarithmic spectrum envelope data from the speech wave; a parameter conversion unit 21, similar to the unit 2 in FIG. 1, for forming the mel cepstrum coefficients from the logarithmic spectrum envelope data; a memory 22 for storing the mel cepstrum coefficient corresponding to each unit speech data; a ruled synthesis unit 23 for generating a synthesized speech from the data of a line of arbitrary characters; a character line analysis unit 24 for analyzing the entered line of characters; a rule unit 25 for generating the parameter connecting rule, pitch information and voiced/unvoiced information, based on the result of analysis in the character line analysis unit 24; a parameter connection unit 26 for connecting the mel cepstrum coefficients stored in the memory 22 according to the parameter connecting rule of the rule unit 25, thereby forming a time-sequential line of mel cepstrum coefficients; and a synthesis unit 27, similar to the unit 3 shown in FIG. 1, for generating a synthesized speech, from the time-sequential line of mel cepstrum coefficients, pitch information and voiced/unvoiced information.

The function of the present embodiment will be explained in the following, with reference to FIG. 6.

At first the unit speech data generating unit 19 prepares data necessary for the speech synthesis by a rule. More specifically the speech constituting the unit of ruled synthesis (for example speech of a syllable) is analyzed (analysis unit 20), and a corresponding mel cepstrum coefficient is determined (parameter conversion unit 21) and stored in the memory unit 22.

Then the ruled synthesis unit 23 generates synthesized speech from the data of an arbitrary line of characters. The data of input character line are analyzed in the character line analysis unit 24 and are decomposed into information of a single syllable. The rule unit 25 prepares, based on the information, the parameter connecting rules, pitch information and voiced/unvoiced information. The parameter connecting unit 26 connects necessary data (mel cepstrum coefficients) stored in the memory 22, according to the parameter connecting rules, thereby forming a time-sequential line of mel cepstrum coefficients. Then the synthesis unit 27 generates rule-synthesized speech, from the pitch information, voiced/unvoiced information and time-sequential data of mel cepstrum coefficients.

The foregoing two embodiments utilize the mel cepstrum coefficients as the parameters, but the obtained parameters become equivalent to the cepstrum coefficients by providing the condition $\alpha=0$ in the equations (4), (6), (9) and (10). This is easily achievable by deleting the mel approximation scale forming unit 10 and the frequency axis conversion unit 11 in case of FIG. 3 or deleting the mel cepstrum conversion unit 18 in case of FIG. 5, and replacing the synthesizing filter unit 16 in FIG. 4 with a logarithmic magnitude approximation (LMA) filter.

As explained in the foregoing, the present invention provides an advantage of obtaining a synthesized speech of higher quality, by sampling the logarithmic power spectrum determined from the speech wave with a basic frequency, applying a cosine polynomial model to thus obtained sample points to determine the spectrum envelope, calculating the mel cepstrum coefficients from said spectrum envelope, and effecting speech synthesis with the LMSA filter utilizing said mel cepstrum coefficients.

What is claimed is:

1. A method for speech analysis and synthesis comprising the steps of:

sampling a short-period power spectrum of speech input into an apparatus with a sampling frequency to obtain sample points, said sampling frequency being controlled so as to trace a basic frequency of input voiced speech:

applying a cosine polynomial model to the thus obtained sample points to determine a spectrum envelope;

calculating mel cepstrum coefficients from the spectrum envelope; and effecting speech synthesis utilizing the mel cepstrum coefficients as filter coefficients of a mel logarithmic spectrum approximation filter used for speech synthesis.

2. A method according to claim 1, wherein said calculating step comprises the step of converting the frequency axis of the spectrum envelope into a mel approximation scale and applying an inverse Fast Fourier Transform operation to the mel logarithmic spectrum envelope.

3. A method according to claim 1, wherein said calculating step comprises the step of applying an inverse Fast Fourier Transform process to the spectrum envelope to determine the cepstrum coefficients and applying regressive equations on the cepstrum coefficients.

4. A method according to claim 3, wherein said regressive equations comprise following equations:

$$\mu_k^{(n)} = \begin{cases} C_{(-n)} + \alpha\mu_0^{(n-1)}, & k=0 \\ (1-\alpha^2)\mu_0^{(n-1)} + \alpha\mu_1^{(n-1)}, & k=1 \\ \mu_{k-1}^{(n-1)} + \alpha(\mu_k^{(n-1)} - \mu_{k-1}^{(n)}), & k>1 \end{cases}$$

$n = \ldots, -2, -1, 0$ $C_\alpha(m) = \mu_m^{(0)}$, m = 0, 1, 2, . . .

5. A method for speech analysis comprising the steps of:

inputting a speech wave form into an apparatus;

extracting a power spectrum from the speech wave form inputted in said inputting step;

extracting pitch information of the input voiced speech from the power spectrum extracted in said power spectrum extracting step;

sampling the power spectrum extracted in said power spectrum extracting step with a sampling interval to produce sample data, said sampling interval being controlled so as to vary in accordance with a pitch interval of the input voiced speech extracted in said pitch information extracting step;

generating a spectrum envelope from the sample data obtained in said sampling step; and transmitting the kind of the voiced speech, the pitch information and said spectrum envelope as parameters of the input speech.

6. An apparatus for speech analysis and synthesis comprising:

means for sampling a short-period power spectrum of speech input into said apparatus with a sampling frequency to obtain sample points, said sampling frequency being controlled so as to trace a basic frequency of input voiced speech;

means for applying a cosine polynomial model to the thus obtained sample points to determine a spectrum envelope;

means for calculating mel cepstrum coefficients from the spectrum envelope; and means for effecting speech synthesis utilizing the mel cepstrum coefficients as filter coefficients of a mel logarithmic spectrum approximation filter used for speech synthesis.

7. An apparatus according to claim 6, wherein said calculating means comprises means for converting the frequency axis of the spectrum envelope into a mel approximation scale and applying an inverse Fast Fourier Transform operation of the mel logrithmic spectrum envelope.

8. An apparatus according to claim 6, wherein said calculating means comprises means for applying an inverse Fast Fourier Transform process to the spectrum envelope to determine the cepstrum coefficients and applying regressive equations of the cepstrum coefficients.

9. An apparatus according to claim 8, wherein said regressive equations comprise following equations:

$$\mu_k^{(n)} = \begin{cases} C(-n) + \alpha\mu_0^{(n-1)}, & k=0 \\ (1-\alpha^2)\mu_0^{(n-1)} + \alpha\mu_1^{(n-1)}, & k=1 \\ \mu_{k-1}^{(n-1)} + \alpha(\mu_k^{(n-1)} - \mu_{k-1}^{(n)}), & k>1 \end{cases}$$

$n = \ldots, -2, -1, 0$ $C_\alpha(m) = \mu_m^{(0)}$, m = 0, 1, 2.

10. An apparatus for speech analysis comprising:

means for inputting a speech wave form into an apparatus;

means for extracting a power spectrum from the speech wave form inputted by said inputting means;

means for extracting pitch information of the input voiced speech from the power spectrum extracted by said power spectrum extracting means;

means for sampling the power spectrum extracted by said power spectrum means with a sampling interval to produce sample data, said sampling interval being controlled so as to vary in accordance with a pitch interval of the input voiced speech extracted by said pitch information extracting means;

means for generating a spectrum envelope from the sample data obtained by said sampling means; and means for transmitting the kind of the voiced speech, the pitch information and said spectrum envelope as parameters of the input speech.

* * * * *

UNITED STATES PATENT AND TRADEMARK OFFICE

CERTIFICATE OF CORRECTION

PATENT NO. : 5,485,543

DATED : January 16, 1996

INVENTOR(S) : TAKASHI ASO

It is certified that error appears in the above-indentified patent and that said Letters Patent is hereby corrected as shown below:

ON THE COVER PAGE

[57] ABSTRACT

Line 9, "thereat," should read --thereof,--.

SHEET 3 OF THE DRAWINGS

FIGURE 6

Between Box 25 and 27, "Voised/Unvoised" should read --Voiced/Unvoiced--.

COLUMN 1

Line 29, "spectrum envelope" should read --Spectrum Envelope--.

Line 31, "the" (first occurrence) should be delete.

Line 48, "Also" should read --Also,--.

COLUMN 4

Line 4, However" should read --However,--.

Line 24, "specifically" should read --specifically,--.

Line 57, "$\Omega = \beta(\Omega)$" should read --$\tilde{\Omega} = \beta(\Omega)$--.

UNITED STATES PATENT AND TRADEMARK OFFICE

CERTIFICATE OF CORRECTION

PATENT NO. : 5,485,543 Page 2 of 2

DATED : January 16, 1996

INVENTOR(S) : TAKASHI ASO

It is certified that error appears in the above-indentified patent and that said Letters Patent is hereby corrected as shown below:

COLUMN 5

Line 1, "$G_m(\Omega)$" should read --$G_m(\tilde{\Omega})$--.

Line 3, "$G_m(\Omega) = G_1(\beta^{-1}(\Omega))$" should read --$G_m(\tilde{\Omega}) = G_1(\beta^{-1}(\tilde{\Omega}))$--.

Signed and Sealed this

Twenty-fifth Day of June, 1996

Bruce Lehman

*Attest:*

BRUCE LEHMAN

*Attesting Officer*

*Commissioner of Patents and Trademarks*